US006024443A

United States Patent [19]

Muhl et al.

[11] Patent Number: 6,024,443

[45] Date of Patent: Feb. 15, 2000

[54] SYSTEM FOR SUPPLYING INK TO AN INK JET HEAD

[75] Inventors: Wolfgang Muhl; Michael Seikel, both of Berlin, Germany

[73] Assignee: Francotyp Postalia AG & Co., Birkenwerder, Germany

[21] Appl. No.: 08/987,547

[22] Filed: Dec. 9, 1997

[30] Foreign Application Priority Data

Dec. 9, 1996 [DE] Germany ..... 196 51 047

[51] Int. Cl.[7] ..... B41J 2/175

[52] U.S. Cl. ..... 347/85

[58] Field of Search ..... 347/85, 86, 87, 347/94

[56] References Cited

U.S. PATENT DOCUMENTS

| | | | |
|---|---|---|---|
| 4,703,333 | 10/1987 | Hubbard | 347/40 |
| 4,872,026 | 10/1989 | Rasmussen et al. | 347/56 |
| 5,646,658 | 7/1997 | Thiel et al. | 347/49 |

FOREIGN PATENT DOCUMENTS

| | | |
|---|---|---|
| 0383558A1 | 8/1990 | European Pat. Off. . |
| 4309255A1 | 9/1994 | Germany . |

OTHER PUBLICATIONS

Japanese Patent Abstract No. 55–161667 (Kawamura), dated Dec. 16, 1980.

*Primary Examiner*—N. Le

*Assistant Examiner*—Michael Nghiem

*Attorney, Agent, or Firm*—Herbert L. Lerner; Laurence A. Greenberg

[57] ABSTRACT

The system for supplying ink to an ink jet head includes a plurality of modules in a stacked construction. Several ink jet printing modules are supplied jointly through a flexible connection, via an ink hose extending between the ink jet head and an ink tank. One common adapter connects to an inlet connection neck for each module. The inlet connection necks communicate fluidically with a common supply conduit present in tabs, which are formed on the faces of the printing modules, and which extend parallel to a side edge of the modules. The common adapter has a pressure equalization diaphragm and a filter, and it is mounted resiliently and rubber-elastically on the inlet connection necks. The pressure fluctuations are thereby balanced out, drafts of air in individual jets are limited, and soiling of the ink conduits by foreign particles is prevented. The rubber-elastic connection of the adapter and the inlet connection neck with the ink jet printing modules makes the relatively low demands made in terms of tolerance in the ink supply independent of the very stringent demands in terms of tolerance in the modular construction.

7 Claims, 9 Drawing Sheets

SYSTEM FOR SUPPLYING INK TO AN INK JET HEAD

BACKGROUND OF THE INVENTION

1. Field of the Invention

The invention relates to a system for supplying ink to an ink jet head, in particular an ink jet head that is composed of a plurality of modules in a stacked construction.

Such ink jet heads are used both in office printers and in small high-speed printers—the type needed for postage meters and product labeling devices—and, as a rule, have a relatively large number of jets.

Precisely in the latter application, a high degree of reliability is required, so that errors in printout, which can have major cost consequences, are avoided.

A component with especially major influence on the reliability of a printer is the ink jet head, along with its supply.

2. Description of the Related Art

An ink jet head composed of a plurality of modules is known from the prior art. See U.S. Pat. No. 4,703,333 to Hubbard. Each module has a number of jets and comprises a plurality of stacked plates with ink jet printing chambers and ink supply conduits machined into them. The module is a system of inclined and stacked arrays and it is constructed on the sideshooter principle. In other words, the jet conduits or openings extend crosswise through an outer plate. The pressure wave in the ink jet printing chamber extends in the direction of the jet conduit, so that the ink droplets are expelled orthogonally to the plate. Correspondingly, ink inlet conduits and openings for the ink supply are provided crosswise through the outer plate on the opposite of the module. To that end, one inlet neck is mounted on the plate above each ink inlet opening. The inlet necks, located in a line one after the other, of all the modules communicate with an ink tank via a common adapter with a following ink hose. The adapter is embodied as a fluid distributor element. Necks that are slipped onto the inlet necks of the modules are located on its ink outlet side. On its ink inlet side, there is a neck onto which the ink hose is slipped. The problem of pressure equilibrium for the ink inlet is still not addressed here.

Both for reasons of unhindered ink expulsion—via a side wall (side shooter)—and of the required space for the ink inlet, a scaled and offset system of the modules is necessary. This in turn requires a correspondingly large amount of space.

A multicolor ink jet printer is also known—see German patent disclosure DE 33 35 614 A1—in which fixed ink conduits lead from various ink tanks to the ink jet head. Because of this rigid connection, the ink jet head and the ink tanks must always be moved jointly. This is problematic, given the relatively large mass.

On the other hand, an ink jet head of stacked construction made of individual modules is known that operates by the edgeshooter principle. See German Patent DE 44 43 254 C1. The individual module comprises three plates located one above the other. When the modules are assembled to make an ink jet head, spacer parts are also inserted between adjacent modules. Nothing further is the about how the ink is supplied.

A module for an ink jet head has become known from German patent disclosure DE 44 43 245 A1 which comprises two switch modules and one ink jet printing module, disposed between them, operating on the edge shooter principle. The ink jet printing module is composed of a first cover plate, a middle plate, and a second cover plate, as well as piezoelectric actuators that are disposed on the cover plates. Ink jet printing chambers are formed into the cover plates, and jet openings with jet conduits are formed into the middle plate; all the jet openings are located in the same plane. Once again, the ink supply per se is still not addressed.

A configuration for an ink jet head in piezo-planar technology is also known—see German Utility Model DE 295 21 128 U1—in which plates are layered one above the other, and ink supply conduits, ink jet printing chambers, jet conduits and jet openings are formed into them. The ink supply conduits are supplied from a common supply conduit.

Finally, a pressure absorber for an ink jet printer is known as well in the prior art. See European patent disclosure EP 0 383 558 A1. The pressure absorber is inserted as a separate component group between an ink tank and an ink jet head and communicates with them via one ink hose each. In this way, the pressure absorber also acts as an ink supply unit. The pressure absorber has a pressure equalization diaphragm. The design and mode of connection allow only a one-piece ink jet head, which is embodied by the edge shooter principle.

SUMMARY OF THE INVENTION

It is accordingly an object of the invention to provide a system for supplying ink to an ink jet head, which overcomes the above-mentioned disadvantages of the heretofore-known devices and methods of this general type and which can be selectively composed of individual modules by the edgeshooter or the sideshooter principle in a stacked construction. In particular, the point of departure for the invention described herein should be a module in accordance with the above-mentioned German Patent DE 44 43 254 C1, whose ink jet printing module has one common supply conduit for all the ink supply conduits of the ink jet printing chambers. All the ink jet printing modules should be supplied in common by means of a flexible connection via an ink hose between the ink jet head and the ink tank, and the single common adapter for multiple ink jet printing modules should be retained.

With the foregoing and other objects in view there is provided, in accordance with the invention, a system for supplying ink to an ink jet head, comprising:

- a plurality of individual modules each formed with an inlet connection neck;
- a common adapter for the modules, the adapter being formed as a fluid distributor element and being mounted on a side thereof resiliently and rubber-elastically on the inlet connection necks, the common adapter being formed with a neck for connecting an ink hose to an ink supply tank, and being provided with a pressure equalization diaphragm;
- each of the modules including an ink jet printing module having a tab formed laterally on a face end thereof, whereby a respective one of the inlet connection necks is mechanically and fluidically coupled to the tab; and
- the ink jet printing module being formed with at least one common supply conduit for supplying ink jet printing chambers in the print head, the conduit extending into the tab.

Because the inlet connection neck is disposed parallel to a side edge of the ink jet printing module and because of the fluid coupling via tabs extended laterally outward on the face end, a compact structure of the ink jet head is achieved.

This embodiment is especially advantageous for ink jet heads that are composed of a plurality of modules and operate by the so-called "non-interlaced" principle. The modules are then arranged with their row of jets obliquely to the travel direction of the print carrier in such a way that each module prints one strip of the printed image. In this way, the printed image is composed of individual strips, whose number is equal to the number of modules. One module with its first jet continues the printed image below the printing point of the first jet of the preceding module, at a spacing that is equivalent to one row of jets. The resultant spacing of the modules from one another is adequate enough, in the system of the invention, that even a generous dimensioning of the components for the ink supply is possible.

In accordance with an added feature of the invention, the ink jet printing module comprises three mutually adjacent plates each formed with a lateral partial tab, the partial tabs covering one another and together forming the tab on the ink jet printing module to which the respective inlet connection neck is coupled parallel to an associated side edge of the ink jet printing module;

the mutually adjacent plates thereby form a stack of plates with an outer plate and a middle plate, wherein the outer plate has a bore formed therein which communicates with the common supply channel on one side, via a labyrinth connection through the middle plate; and an ink tank and an ink hose connecting the adapter to the ink tank, the bore in the outer plate communicating with the ink tank via an angle bore in the inlet connection neck and a labyrinth connection in the adapter with a flanged-on neck and via the ink hose slipped onto the neck.

In accordance with an additional feature of the invention, the inlet connection neck includes a flange part with a sealing ring in the flange part, and a tubular part with a rubber-elastic sealing bush slipped onto the tubular part, and a substantially U-shaped clamp securing the inlet connection neck to a respective the ink jet printing module.

Furthermore, the flange part is formed with a recess for receiving the tab, and with a recess for receiving the sealing ring, and it has a flange wall formed with a bead for arresting the clamp.

The clamp rests force-lockingly on one side on the flange wall with the bead and on the other side on the tab, and the sealing ring rests force-lockingly on the flange part on one side, encompassing the angle bore, and on the other side on the tab and encompassing the bore.

Finally, the sealing bush is a hat-shaped bush comprising a shaft and a brim and it rests with one end of the shaft on a shoulder of the flange part.

In accordance with another feature of the invention, the common adapter has a base body for coupling to the inlet connection necks, and a flanged-on neck for coupling an ink supply hose to the common adapter;

a portion of the base body oriented toward the inlet connection necks having a recess with bores formed therein, the hat-shaped part of the sealing bushes resting force-lockingly in the recess, and the tubular parts protruding with a conically tapered free end thereof into associated ones of the bores;

a portion of the base body remote from the inlet connection necks having an ink chamber formed therein, the ink chamber:

communicating directly with the bores, having a pressure equalization diaphragm closing the ink chamber, and communicating hydraulically with an opening in the flange part, wherein the flange part is formed onto the base body orthogonally to the ink chamber;

the flange part has a recess for receiving a filter and an outwardly adjoining recess for receiving a sealing ring and for docking the collar of the flanged-on neck.

In accordance with a preferred embodiment of the invention, the clamp is formed of ink-resistant spring material.

In accordance with a further feature of the invention, the pressure equalization diaphragm is an ink-resistant, diffusion-proof plastic film secured to the base body, and the flange part of the base body has a stop for the neck. The stop is adapted to a contour of the collar of the neck and serves as a guide therefor.

In accordance with a concomitant feature of the invention, the plastic film is secured to the base body by thermal compression or by ultrasonic welding.

Since a pressure equalization diaphragm is already present in the common adapter directly on the ink jet head, pressure fluctuations are compensated for faster and better, and a draft in the jets is counteracted more successfully than if this diaphragm were present only downstream of a hose connection or in the ink tank.

The situation is similar for the easily replaced insertion of a filter in the adapter. Small particles that are present in the ink line are effectively filtered out, and the jets are thus protected against stopping up.

The rubber-elastic connection of the adapter to the inlet connection neck, and the form- and force-locking connection of the inlet connection necks to the tabs on the ink jet printing module enable a strict separation between the very stringent demands in terms of tolerance for the module and the relatively low demands in terms of tolerance for the ink supply system.

If the ink jet head comprises only a single module, then it is also possible to integrate the pressure equalization diaphragm and the filter into the flange part of the inlet connection neck.

Other features which are considered as characteristic for the invention are set forth in the appended claims.

Although the invention is illustrated and described herein as embodied in a system for supplying ink to an ink jet head, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
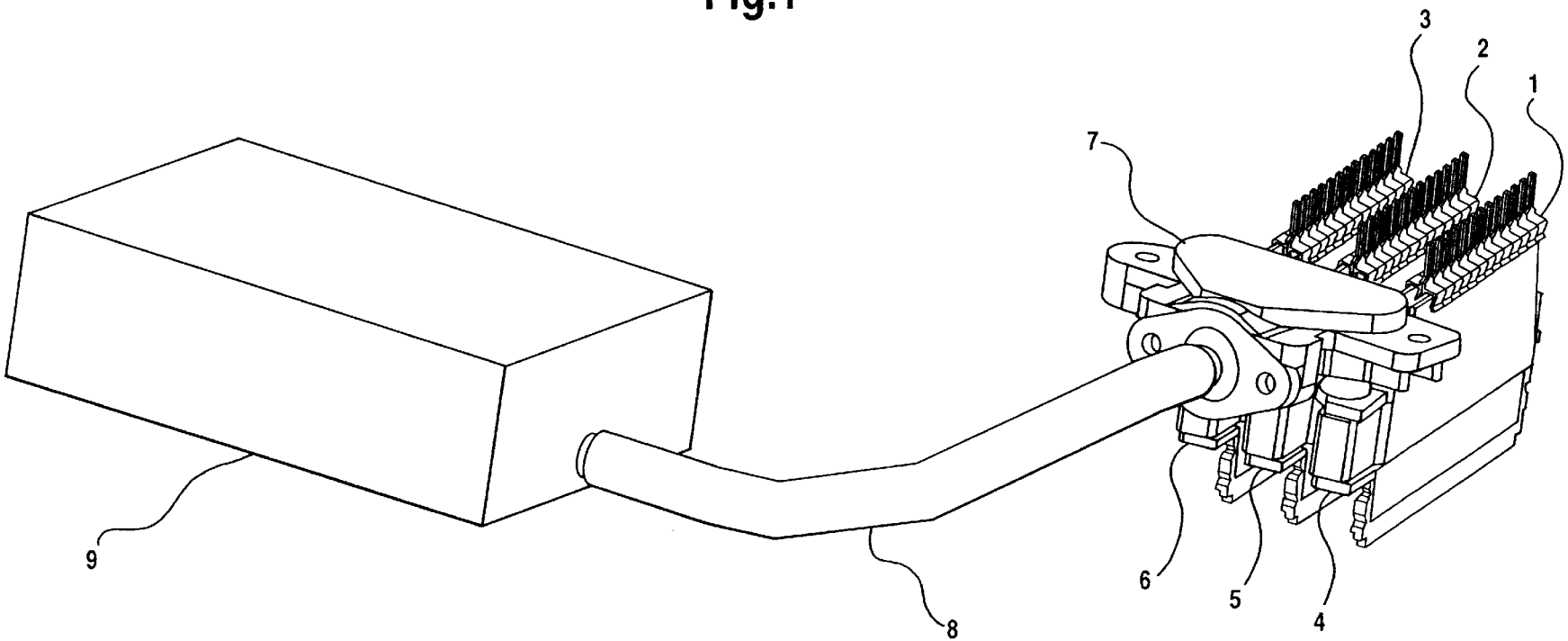
FIG. 1 is a perspective view of an ink supply system according to the invention, with three modules.

Referring now to the figures of the drawing in detail it should first be noted that the drawing is partly schematic so as to simplify and aid in the comprehension. With particular reference to FIG. 1, three identical modules 1, 2, 3 of an ink jet head 500 are connected via associated inlet connection necks 4, 5, 6 and common adapter 7, via an ink hose 8, to an ink tank.

Figure 2:
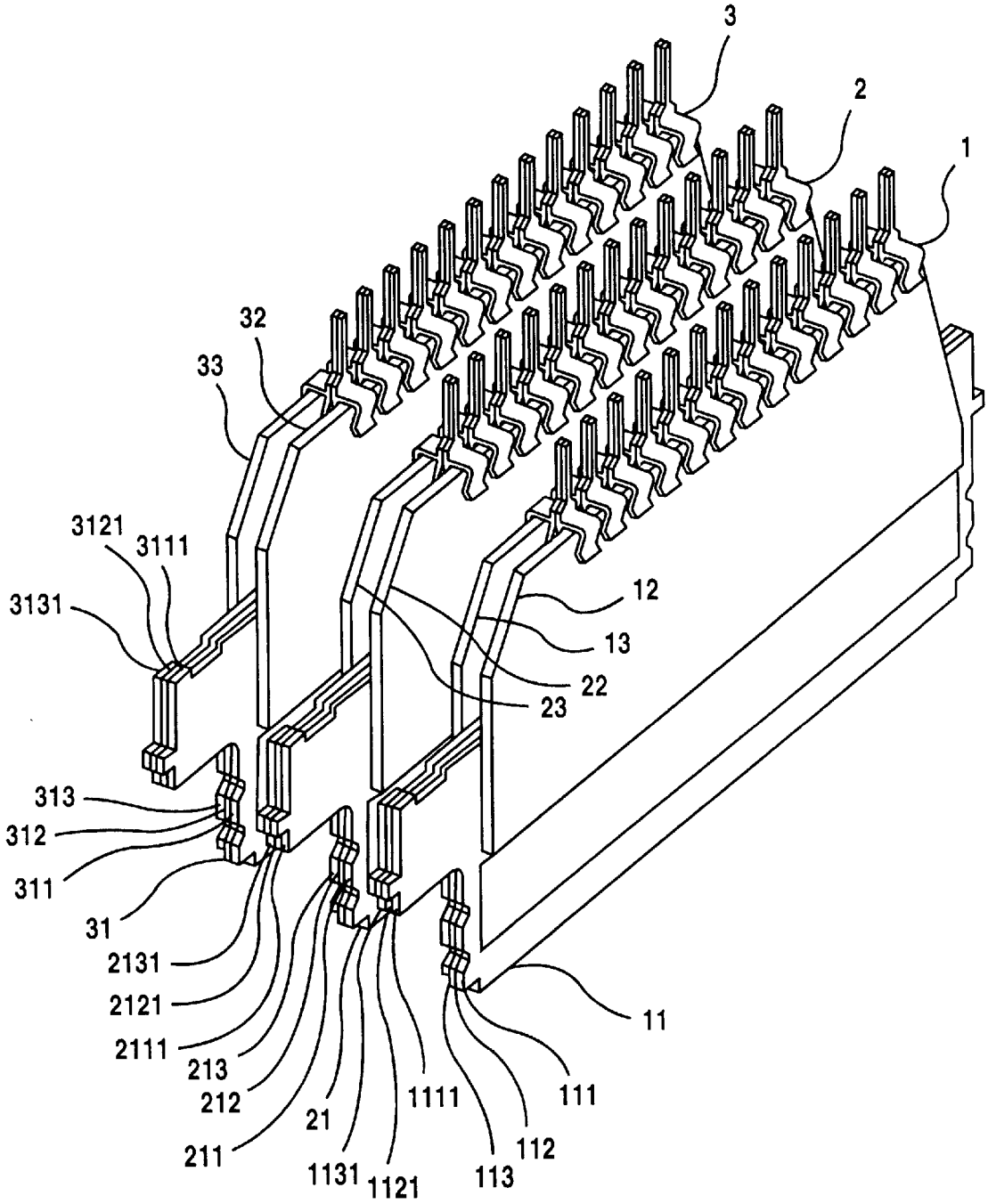
FIG. 2 is a perspective view of three modules.

As seen in FIG. 2, each module 1, 2, 3 is composed in a stacked construction of two switching modules 12, 13; 22, 23; 32, 33 and one ink jet printing module 11, 21, 31 located between them.

In the discussion that follows immediately, only the first ink jet printing module 11 will be described in detail. The conditions for the other ink jet printing modules are analogous, because of the identical construction, so that they need not be described further.

The ink jet printing module 11 is equipped on both sides with piezoelectric actuators, which have been left out of the drawing for the sake of simplicity.

The ink jet printing module 11 comprises three plates 111, 112, 113 stacked one above the other. The first plate 11 serves as a cover plate or diaphragm plate, and into it, ink jet printing chambers 506 ink conduits and one common supply conduit 510 are formed. The second plate or middle plate 112 serves the purpose of acoustical and fluidic separation of the ink jet printing chambers 506 in the cover plates 111, 113. It contains the non-illustrated jet conduits and jet openings. The third plate, or second cover plate 113, is constructed analogously to the first plate 111.

Figures 3, 3A:
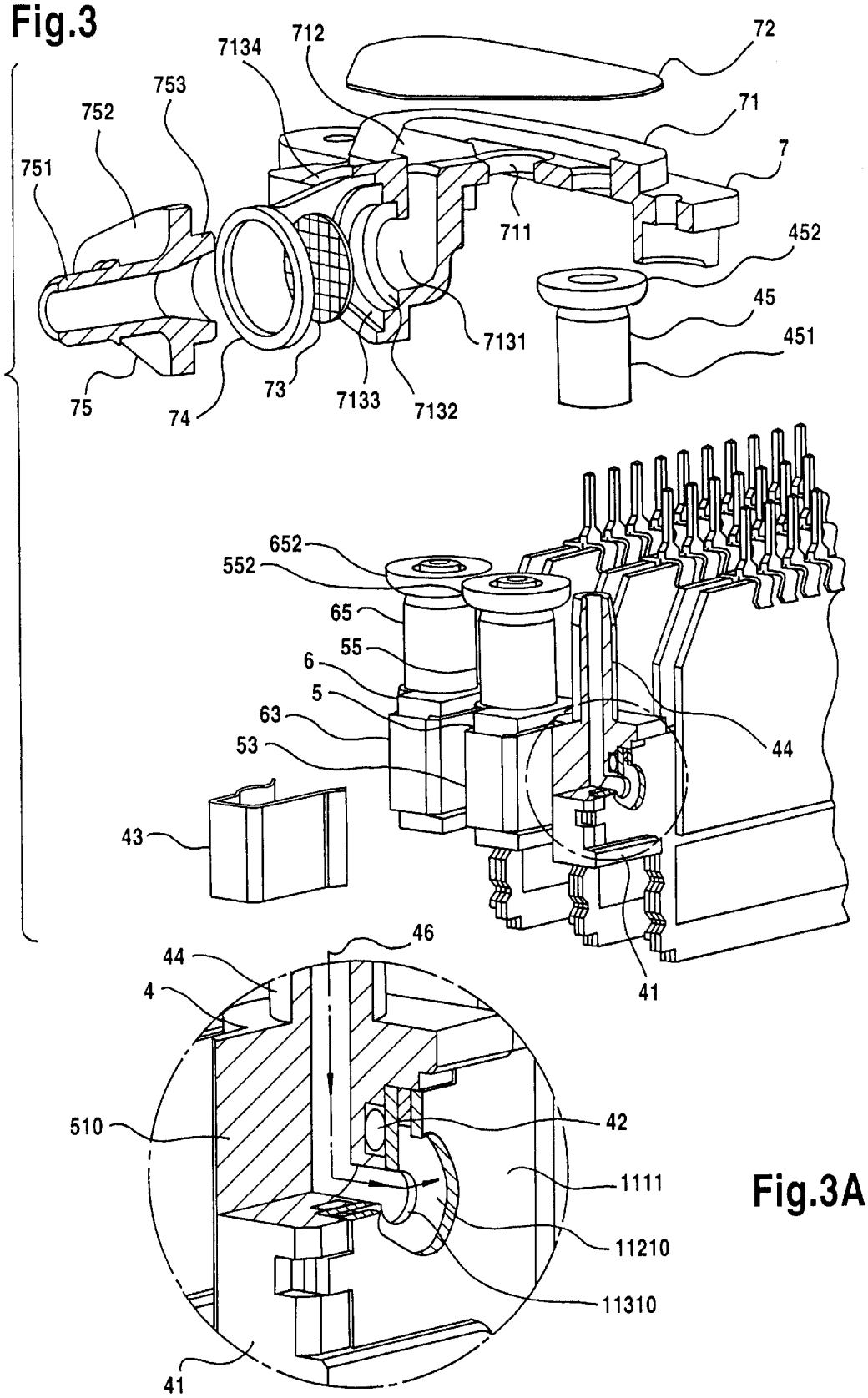
FIG. 3 contains three related views of the configuration of FIG. 1, namely a partly sectional, exploded view, a partial perspective view, and a detail of the partial perspective view.
Figure 4A:
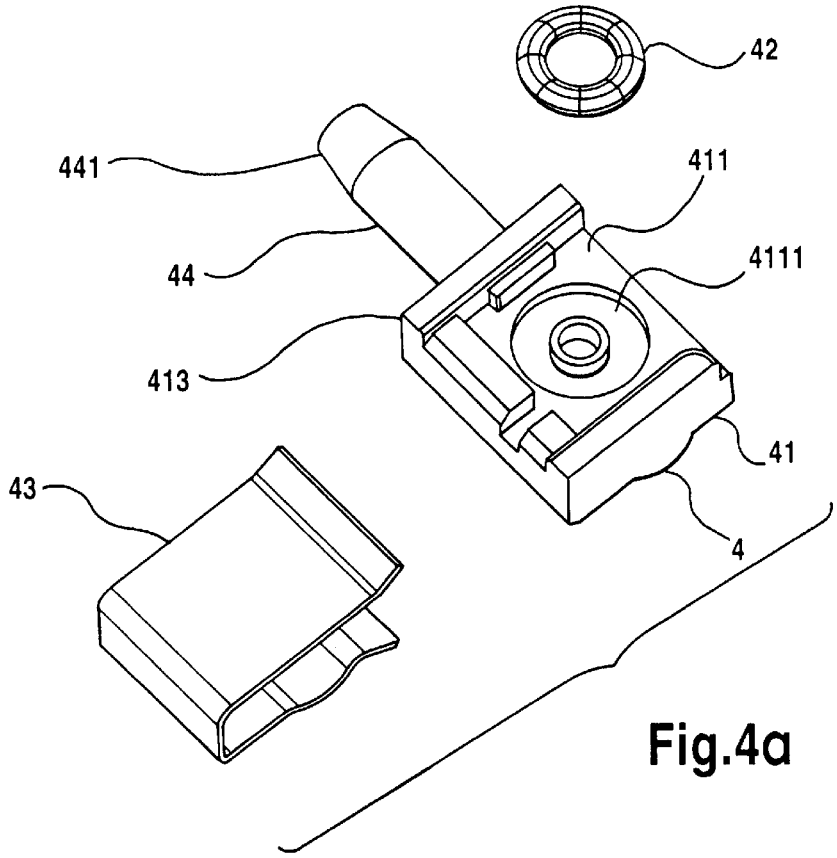
FIG. 4A is an exploded, front perspective view of an inlet connection neck.
Figure 4B:
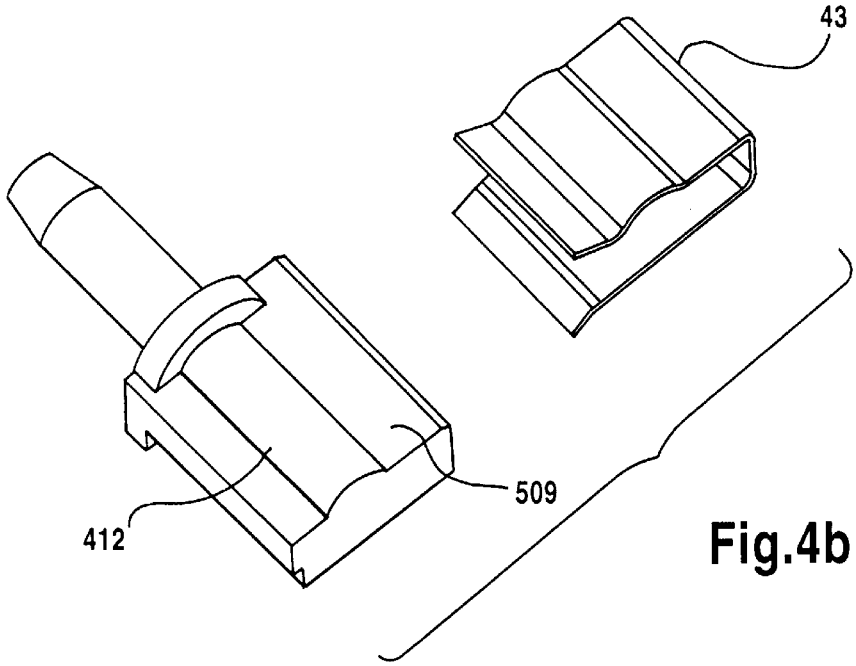
FIG. 4B is a rear perspective view thereof.

With reference to FIG. 3, the inlet connection necks 4, 5, 6 are mounted on the ink jet printing modules 1, 2, 3 laterally parallel to the side edges 11, 21, 31. For the sake of advantageous coupling of the individual inlet connection neck 4 to the associated ink jet printing module 11, the plates 111, 112, 113 are provided with lateral tabs 1111, 1121, 1131. The inlet connection neck 4 is adapted to the contour of the tabs 1111, 1121, 1131, and is secured to them in a form-locking and force-locking fashion with a clamp 43 (see also FIGS. 1, 2 and 4).

All the inlet connection necks 4, 5, 6 are supplied with ink via one common adapter 7 with a labyrinth connection 508 and a pressure equalization diaphragm 72. Flanged to the inlet side of the adapter 7 is a neck 75, onto whose shaft 751 the ink hose 8 is slipped. The neck 75 is provided with a collar 752, which is used for flanging to the adapter 7.

The tab 1131 is provided with a bore 11310, to which the inlet connection neck 4 is docked with an angle bore 46 in its flange part 41. Both bores 11310 and 46 are sealed off by means of a sealing ring 42. The bore 11310 adjoins a recess 11210 in the tab 1121. The recess extends far enough so that a fluidic connection exists via a common supply channel 505 to the non-illustrated common supply conduits in the cover plates 111, 113. This labyrinth connection requires no substantial interventions into the stack of plates in the ink jet printing module 1.

The inlet connection neck 4 is adapted to the contour of the stack of tabs such that the stack is engaged on three edges by the flange part 41. See also FIG. 4*a*. To that end, the flange part 41 is provided with a recess 411, into which the stack of tabs, adapted in shape, is placed. The sealing ring 42 is placed in a further recess 4111 within the recess 411. The requisite contact pressure for the sealing ring 42 is generated by means of the clamp 43, which is slipped laterally via a bead 412 on the flange part 41 on the flange wall 509 and onto the closed face of the tab 1111 and thus holds the inlet connection neck 4 and ink jet printing module 1 together in a form-locking and force-locking fashion. See FIGS. 4*a* and 4*b*.

In this way, the inlet connection neck 4 is locked on the tabs 1111, 1121, 1131 in such a way that it cannot be unintentionally displaced or even removed.

The clamp 43 is expediently formed of ink-resistant spring material. This may be a stainless steel or some suitable polymer, such as acetal copolymer.

The flange part 41 is adjoined by a tubular part 44. The flange part 41 is offset there in such a way that a shoulder 413 is formed. The tubular part 44 is tapered on its free end 441. A hat-shaped sealing bush 45 is slipped onto the tubular part 44 in such a way that its shaft 451 rests on one end on the shoulder 413, and on the other its brim 452 is set back slightly opposite the end 441 of the tubular part 44. There is spacing between the inner bore of the sealing bush 45 and the tapered end 441 of the tubular part 44.

Figure 5A:
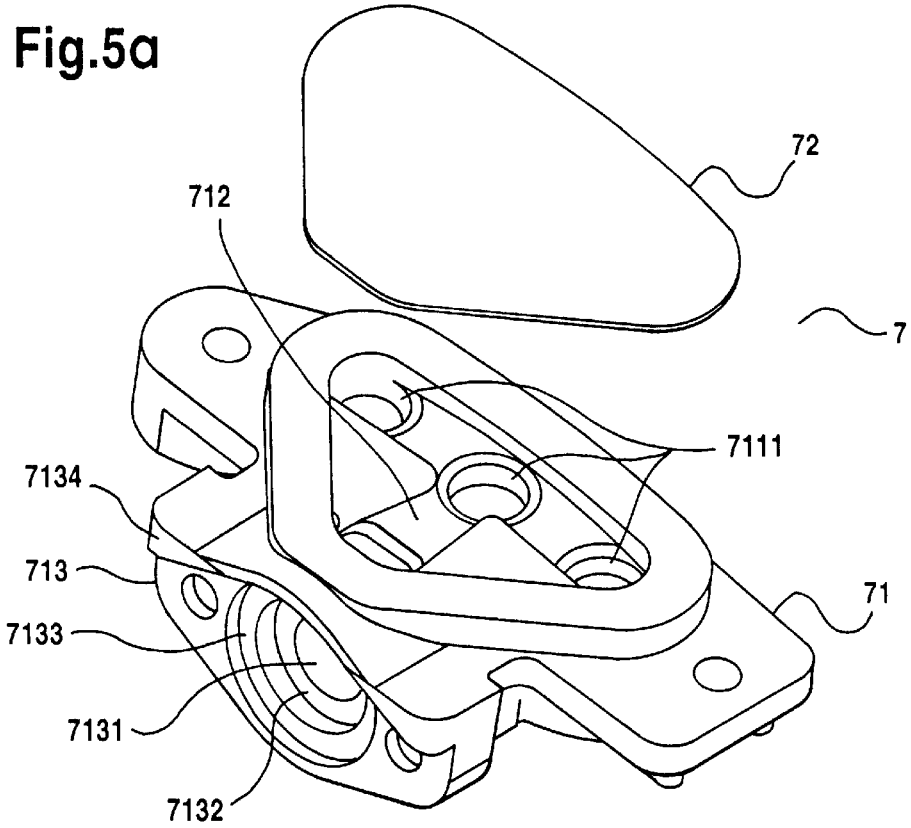
FIG. 5A is an exploded, top perspective view of a base body of the adapter.
Figure 5B:
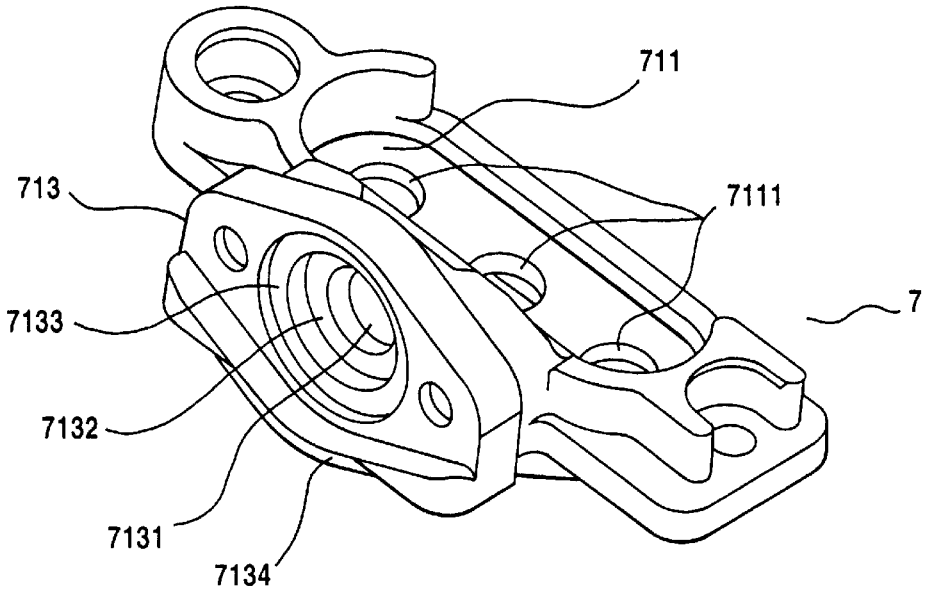
FIG. 5B is a bottom perspective view thereof.

With reference to FIGS. 5*a* and 5*b*, the common adapter 7 for the inlet connection necks 4, 5, 6 comprises a base body 71 with the pressure equalization diaphragm 72 and a flanged-on neck 75. See also FIG. 3.

A filter 73 and a sealing ring 74 are inserted between the neck 75 and the base body 71.

In the base body 71, a recess 711 with bores 7111 is provided; its serves to receive and coupling the inlet connection necks 4, 5, 6. In the assembled state, the inlet connection necks 4, 5, 6 rest in force-locking fashion, with the brim 452, 552, 652 of the sealing bushes 45, 55, 65, in the recess 711, and the tapered ends 441, 541, 641 of the tubular parts 44, 54, 64 protrude into the associated bores 7111. The bores 7111 lead into an ink chamber 712, which is closed on one end, in a manner adapted to the atmosphere, by the pressure equalization diaphragm 72 and on the other end is in fluidic communication with an opening 7131 in the flange part 713. The flange part 713 is mounted on the base body 71 orthogonally to the ink chamber 712. The pressure equalization membrane 72 is secured, in the form of an ink-resistant, diffusion-proof, resilient plastic film, to the base body 71 by thermal compression or by ultrasonic welding.

The flange part 713 has a recess 7132 for receiving the filter 73 and an adjoining, larger recess 7133, for receiving the sealing ring 74. The neck 75 protrudes, with the shoulder 753 protruding in front of the collar 752, into the recess 7133. The collar 752 rests in force-locking fashion on the sealing ring 74. The shoulder 753 and the recess 7132 for the filter 73 are designed in terms of tolerances such that the filter 73 is held by the shoulder 753, and the sealing ring 74 with the collar 752 provides sealing.

To simplify assembly with the neck 75, the flange part 713 is provided with a stop 7134, which is adapted to the contour of the collar 752. The neck 75 is screwed to the flange part 713. The ink hose 8 is slipped onto the shaft 751 of the neck 75.

Figure 6:
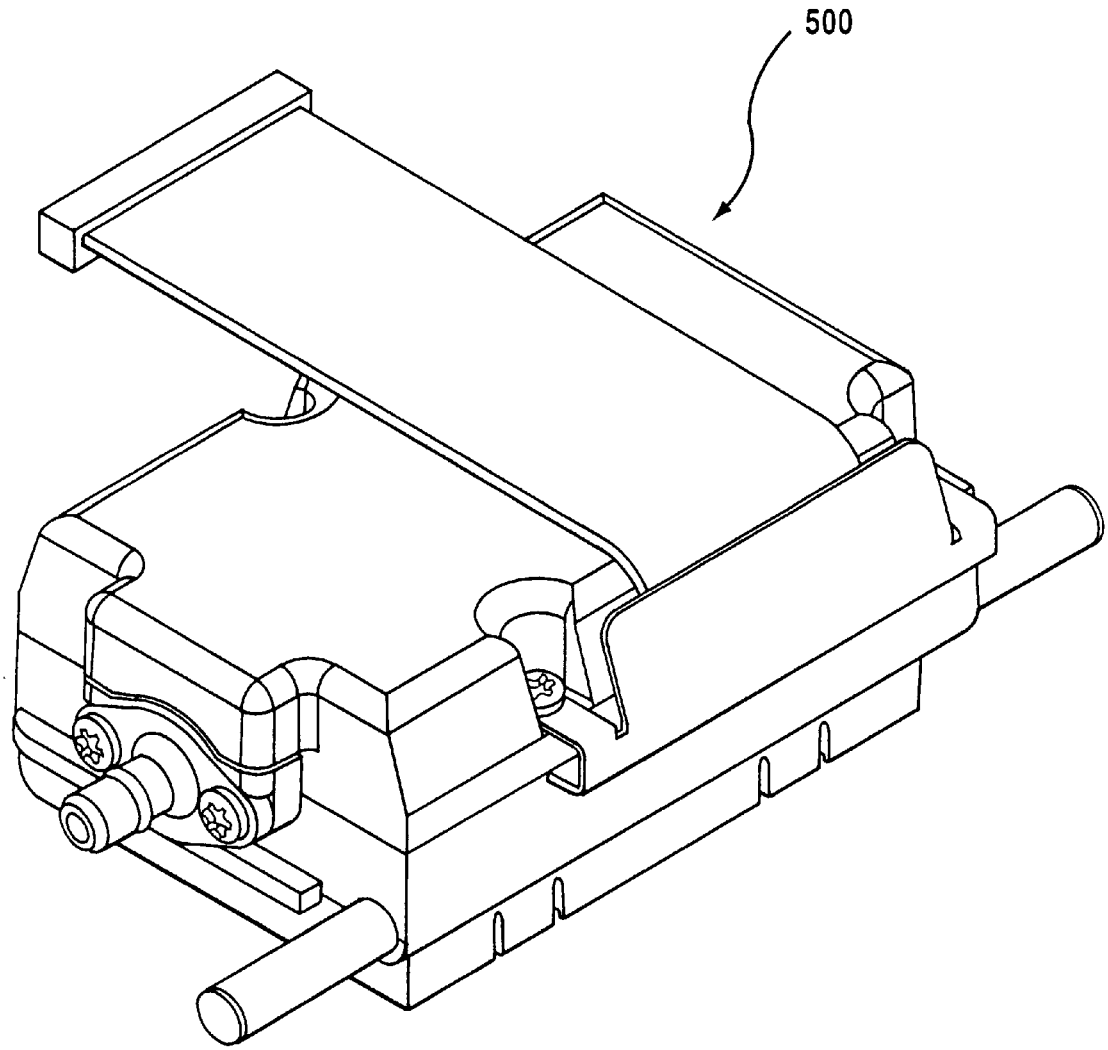

FIG. 6 is a top perspective view of an assembled ink jet head.

Figure 7:
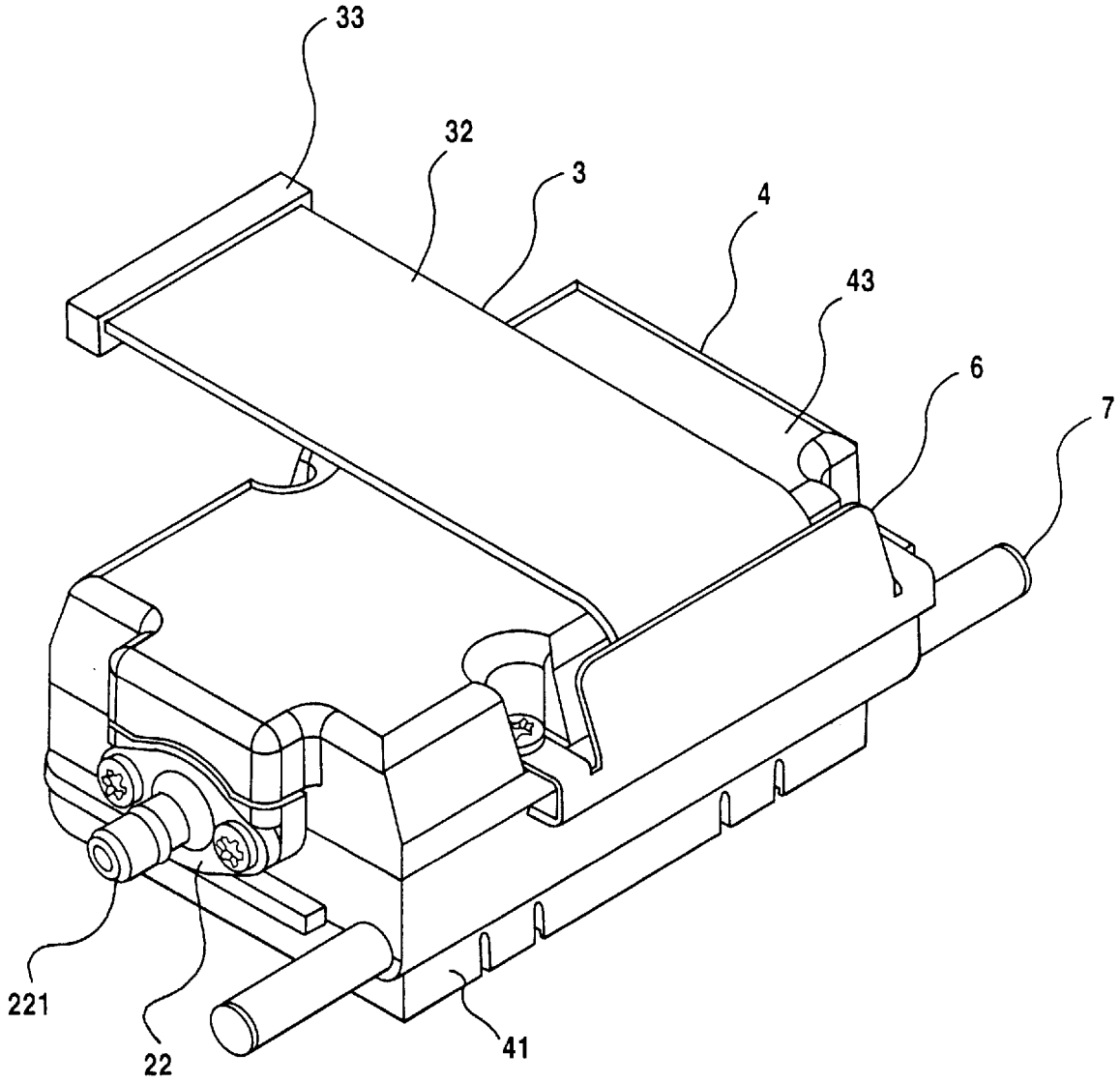
Figure 8:
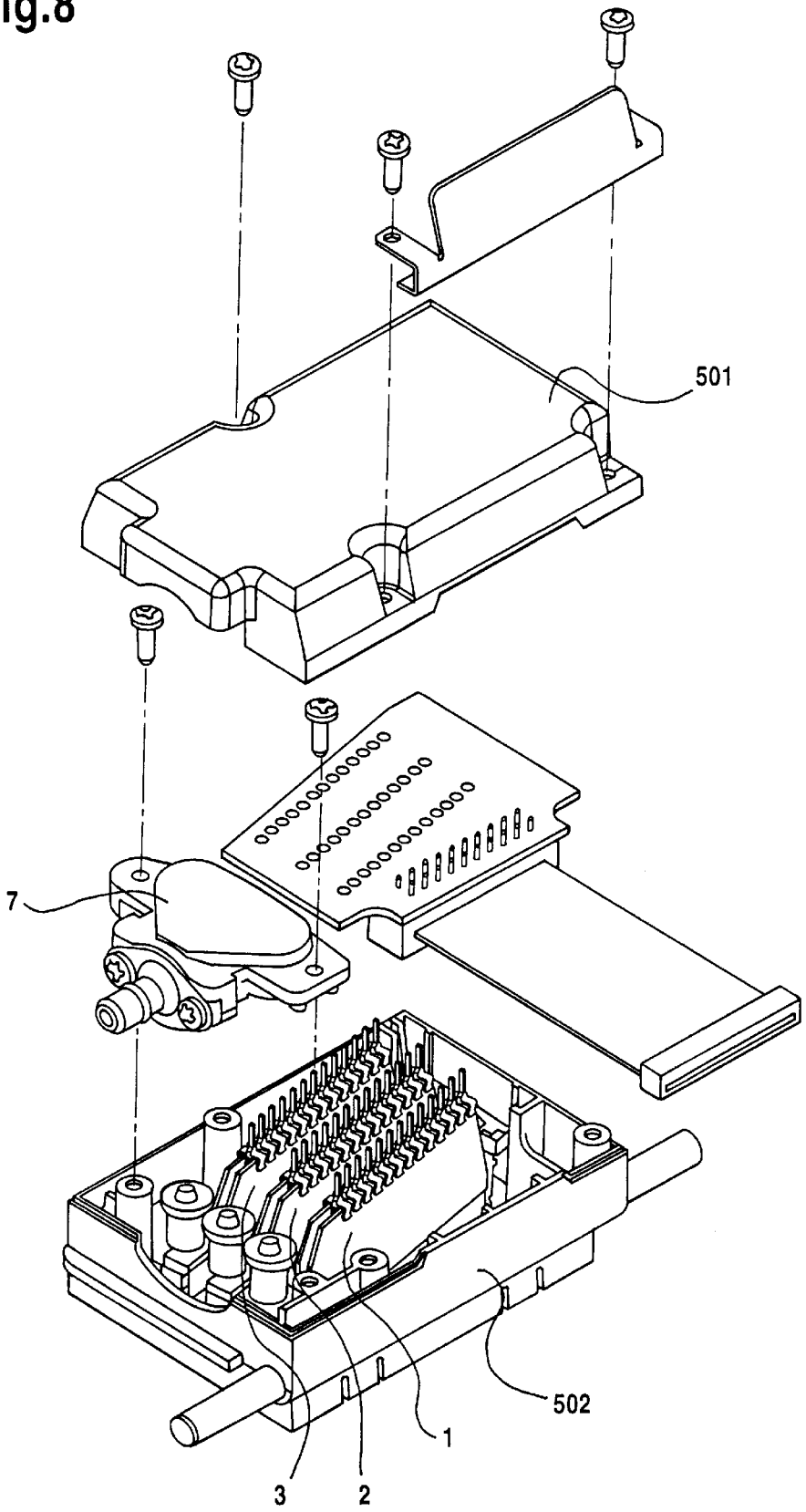
Figure 9:
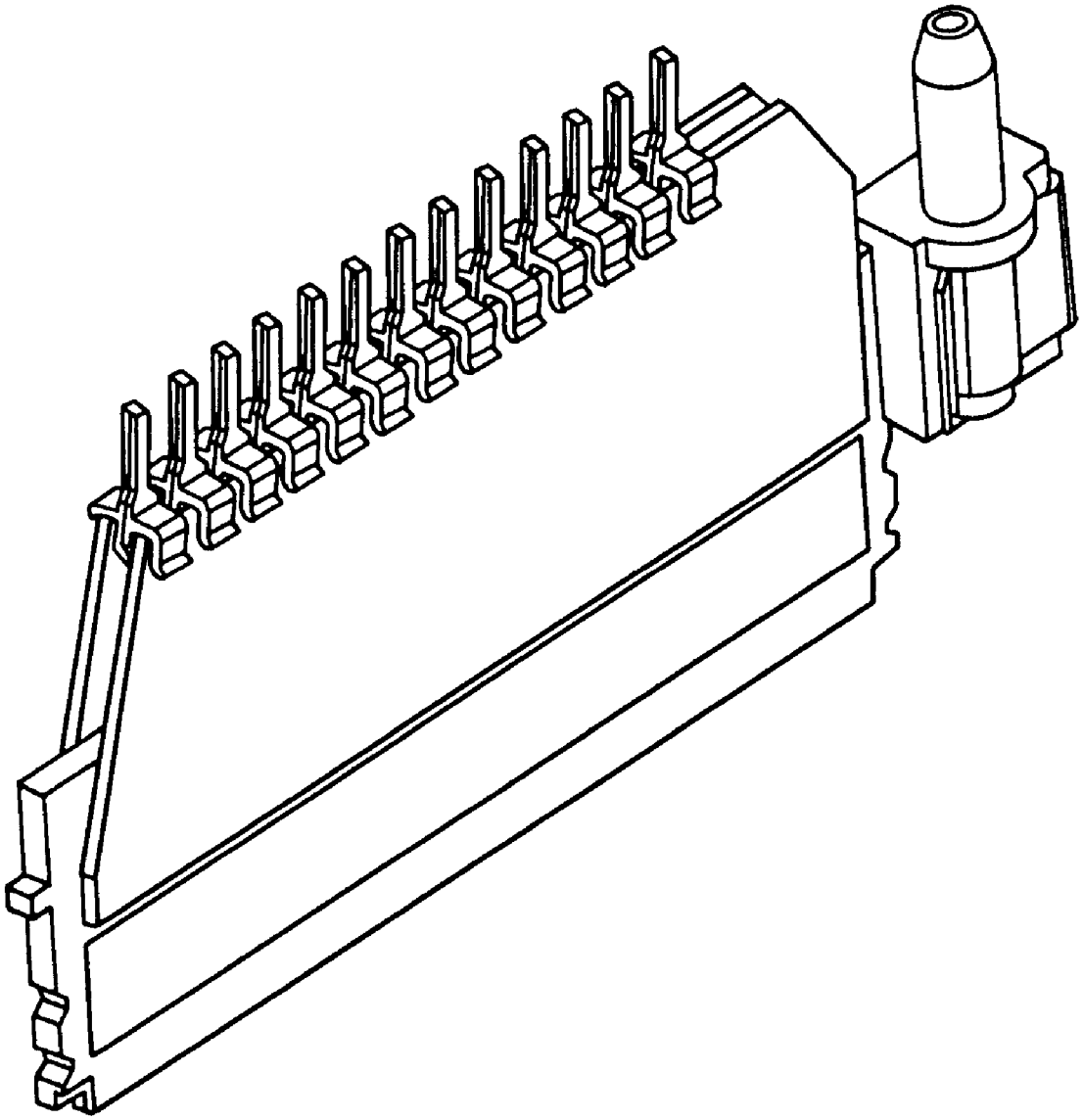

FIG. 7 is an exploded, top perspective view of an ink jet head showing the top assembly housing 501 and the button assembly housing 502. Located inside, are the three modules 1, 2, and 3 and the common adapter 7. FIG. 8 shows a module with the labyrinth connection 507 of the middle plate. FIG.9 shows another view of the module showing the ink jet printing chamber 506.

We claim:

1. A system for supplying ink to an ink jet head, comprising:

plurality of individual modules each formed with an inlet connection neck;

an ink supply tank;

an ink hose connected to said ink supply tank;

a common adapter for said modules, said adapter being formed as a fluid distributor element and being elastically mounted on a side thereof on said inlet connection necks, said common adapter having a common adapter neck and being provided with a pressure equalization diaphragm;

each of said modules including an ink jet printing module having a jet printing chamber, said ink jet printing module existing of three mutually adjacent plates each formed with a lateral partial tab, said partial tabs covering one another and together forming a tab, said respective inlet connection neck being mechanically and fluidically coupled to said tab parallel to an associated side edge of said ink jet printing module;

said ink jet printing module being formed with at least one common supply conduit for supplying ink to said jet printing chambers in the print head, said conduit extending into said tab;

said mutually adjacent plates forming a stack of plates with in outer plate and a middle plate, wherein said outer plate has a printing module bore formed therein which communicates with a common supply channel on one side, via a labyrinth connection through said middle plate; and said printing module bore in said outer plate communicating with said ink tank via an angle bore in said inlet connection neck and a labyrinth connection in said adapter with said common adapter neck and via said ink hose slipped onto said common adapter neck of said adapter.

2. The system according to claim 1, wherein:

said inlet connection neck includes a flange part with a sealing ring in said flange part, and a tubular part with a rubber-elastic sealing bush slipped onto said tubular part, and a substantially U-shaped clamp securing said inlet connection neck to a respective said ink jet printing module;

said flange part being formed with a recess for receiving said tab, and with a recess for receiving said sealing ring, and having a flange wall formed with a bead for arresting said clamp;

said clamp force-lockingly resting on one side on said flange wall with said bead and on the other side on said tab, and said sealing ring force-lockingly resting on said flange part on one side, encompassing the angle bore, and on the other side of said printing module bore encompassing said tab; and wherein said sealing bush is a hat-shaped bush comprising a shaft and a brim and resting with one end of said shaft on a shoulder of the flange part.

3. The system according to claim 2, wherein:

said common adapter has a base body for coupling to said inlet connection necks, and said common adapter neck for coupling said ink supply hose to said common adapter;

a portion of said base body oriented toward said inlet connection necks having a recess with common adapter bores formed therein, said hat-shaped part of said sealing bushel resting force-lockingly in said recess, and said tubular parts protruding with a conically tapered free end thereof into associated ones of said common adapter bores;

a portion of said base body remote from said inlet connection necks having an ink chamber formed therein, said ink chamber:

communicating directly with said common adapter bores having a pressure equalization diaphragm closing said ink chamber, and communicating hydraulically with an opening in said flange part, wherein said flange part is formed onto said base body orthogonally to said ink chamber;

a filter;

said flange part has a recess for receiving said filter and an outwardly adjoining recess for receiving a sealing ring and for docking a collar on said common adapter neck.

4. The system according to claim 3, wherein said pressure equalization diaphragm is an ink-resistant, diffusion-proof plastic film secured to said base body, and wherein said flange part of said base body has a stop for said common adapter neck, said stop being adapted to a contour of said collar of said common adapter neck and serving as a guide therefor.

5. The system according to claim 4, wherein said plastic film is secured to said base body by thermal compression.

6. The system according to claim 4, wherein said plastic film is secured to said base body by ultrasonic welding.

7. The system according to claim 2, wherein said clamp is formed of ink-resistant spring material.

* * * * *